US010228164B2

(12) United States Patent
Nakano et al.

(10) Patent No.: US 10,228,164 B2
(45) Date of Patent: Mar. 12, 2019

(54) STIRLING REFRIGERATOR

(71) Applicant: SUMITOMO HEAVY INDUSTRIES, LTD., Tokyo (JP)

(72) Inventors: Kyosuke Nakano, Nishitokyo (JP); Yoshikatsu Hiratsuka, Nishitokyo (JP); Kenta Yumoto, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 206 days.

(21) Appl. No.: 14/666,459

(22) Filed: Mar. 24, 2015

(65) Prior Publication Data

US 2015/0276272 A1 Oct. 1, 2015

(30) Foreign Application Priority Data

Mar. 25, 2014 (JP) ..... 2014-062413

(51) Int. Cl.

| | |
|---|---|
| ***F25B 9/14*** | (2006.01) |
| ***F28D 17/02*** | (2006.01) |
| *F02G 1/057* | (2006.01) |
| *F01B 29/10* | (2006.01) |

(52) U.S. Cl.

CPC ..... *F25B 9/14* (2013.01); *F28D 17/02* (2013.01); *F01B 29/10* (2013.01); *F02G 1/057* (2013.01); *F02G 2242/42* (2013.01); *F02G 2270/55* (2013.01); *F25B 2309/003* (2013.01)

(58) Field of Classification Search

CPC ..... F28D 17/02; F02G 1/057; F02G 2242/42; F02G 2270/55; F25B 9/14; F25B 2309/003; F01B 29/10

See application file for complete search history.

(56) References Cited

U.S. PATENT DOCUMENTS

| | | | | |
|---|---|---|---|---|
| 6,131,644 | A * | 10/2000 | Kohara | F02G 1/057 165/10 |
| 2006/0179835 | A1* | 8/2006 | Qiu | F28D 17/02 60/521 |
| 2007/0033935 | A1* | 2/2007 | Carroll | F02G 1/055 60/520 |
| 2012/0247143 | A1 | 10/2012 | Matsubara | |

FOREIGN PATENT DOCUMENTS

| | | | |
|---|---|---|---|
| JP | 2000-292022 | A | 10/2000 |
| JP | 2002-039639 | A | 2/2002 |
| JP | 2007-085641 | A | 4/2007 |
| JP | 2007-303721 | A | 11/2007 |
| JP | 2008-215440 | A | 9/2008 |
| JP | 2011-027272 | A | 2/2011 |
| JP | 2012-220044 | A | 11/2012 |

* cited by examiner

*Primary Examiner* — Frantz Jules

*Assistant Examiner* — Webeshet Mengesha

(74) *Attorney, Agent, or Firm* — Buchanan Ingersoll & Rooney PC

(57) ABSTRACT

In a Stirling refrigerator, a regenerator has a low-temperature end and a high-temperature end. A plurality of protrusions, which thermally contact with the low-temperature end of the regenerator, are formed on a low-temperature heat exchanger. The low-temperature heat exchanger has a recess between the protrusions, and the recess forms a flowing groove through which a working gas flows. The regenerator may contain a mesh regenerator material.

3 Claims, 6 Drawing Sheets

STIRLING REFRIGERATOR

RELATED APPLICATION

Priority is claimed to Japanese Patent Application No. 2014-62413, filed on Mar. 25, 2014, the entire content of which is incorporated herein by reference.

BACKGROUND OF THE INVENTION

1. Field of the Invention

The present invention relates to a refrigerator and in particular relates to a Stirling refrigerator including a regenerator.

2. Description of the Related Art

There are available many types of cryogenic refrigerators that produce cryogenic temperatures. One of such cryogenic refrigerators is a Stirling refrigerator. As compared with other cryogenic refrigerators such as a Gifford-MacMahon (GM) refrigerator, the Stirling refrigerator has a feature where the downsizing is easier. Similar to the GM refrigerator, a natural medium such as helium gas or the like is used as a working gas and therefore the Stirling refrigerator is an environmentally-friendly cryocooler.

SUMMARY OF THE INVENTION

One exemplary purpose of an aspect of the present invention is to provide a technology for mitigating or preventing a decrease of the refrigeration capacity of a Stirling refrigerator having a regenerator.

According to an embodiment of the present invention, a Stirling refrigerator includes: a regenerator including a low-temperature end and a high-temperature end; and a heat exchanger on which a plurality of protrusions in thermal contact with the low-temperature end of the regenerator are formed. One or more recesses are formed between the protrusions on the heat exchanger, each recess forming a flowing groove through which a working gas flows.

Optional combinations of the aforementioned constituting elements, and implementations of the invention in the form of methods, apparatuses, systems, and so forth may also be practiced as additional modes of the present invention.

BRIEF DESCRIPTION OF THE DRAWINGS

Embodiments will now be described, by way of example only, with reference to the accompanying drawings, which are meant to be exemplary, not limiting, and wherein like elements are numbered alike in several figures, in which.

DETAILED DESCRIPTION OF THE INVENTION

Figure 1:
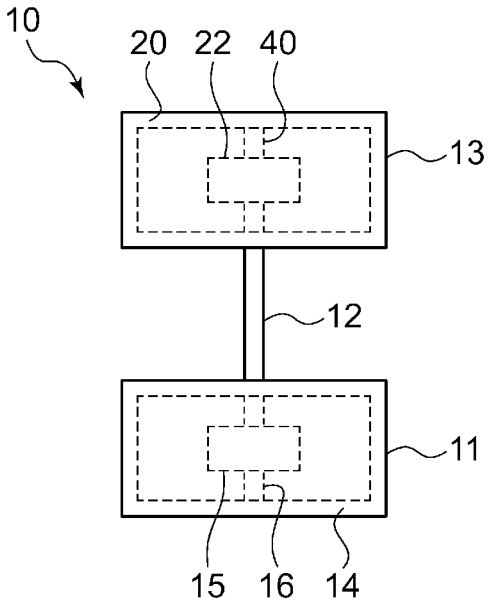
FIG. 1 schematically shows a Stirling refrigerator according to an embodiment of the present invention.

The invention will now be described by reference to the preferred embodiments. This does not intend to limit the scope of the present invention, but to exemplify the invention.

Among Stirling refrigerators, there is a Stirling refrigerator that includes a regenerator. The regenerator contains a regenerator material comprised of metal meshes and the like, and accumulates the coldness produced by a working gas. The regenerator is provided in a position adjacent to a heat exchanger. There are cases where a hollow support member is inserted between the regenerator and the heat exchanger, which is used to form a gap or space therebetween. This is because of not only allowing a cold working gas, which has passed through the heat exchanger, to uniformly cool the regenerator material and but also mitigating or preventing the metal meshes, which are the regenerator material, from being warped or deformed by its own weight and/or by the working gas passing therethrough.

However, the gap formed between the regenerator and the heat exchanger may possibly increase the thermal resistance between the regenerator and the cooled object and thereby deteriorate the refrigerating performance of the refrigerator. In the light of this, a Stirling refrigerator according to an embodiment of the present invention includes a heat exchanger having an external surface with a plurality of protrusions in thermal contact with a low-temperature end of the regenerator.

A detailed description will be hereinafter given of embodiments by which to carry out the present invention, with reference to the accompanying drawings. The same or equivalent constituents in explaining the drawings will be denoted with the same reference numerals, and the repeated description thereof will be omitted as appropriate. Moreover, the embodiments given hereinbelow are for illustrative purposes only and does not limit the scope of the present invention.

FIG. 1 schematically shows a Stirling refrigerator 10 according to an embodiment of the present invention. The Stirling refrigerator 10 or Stirling cryocooler includes a compressor 11, a connecting pipe 12, and an expander 13.

The compressor 11 includes a compressor casing 14. The compressor casing 14 is a pressure vessel that is so configured as to hermetically hold a high-pressure working gas. The working gas as used herein may be helium gas, for instance. Also, the compressor 11 includes a compressor unit that is contained in the compressor casing 14. The compressor unit has a compressor piston and a compressor cylinder, one of which is a movable member 15 configured to reciprocate inside the compressor casing 14 and the other of which is a static member secured to the compressor casing 14. The compressor unit has a drive source used to move the movable member 15 relative to the compressor casing 14 in a direction along a central shaft of the movable member 15. The compressor 11 includes a support 16 that supports the movable member 15 relative to the compressor casing 14 so that the movable member 15 can move in a reciprocating manner. The movable member 15 vibrates relative to the compressor casing 14 and the static member with certain amplitude and frequency. As a result, the volume of the working gas inside the compressor 11 also vibrates with predetermined amplitude and frequency.

A working gas chamber is formed between the compressor piston and the compressor cylinder. The working gas chamber is connected to one end of the connecting pipe 12 through a communicating path formed in the aforementioned static member and the aforementioned compressor casing 14. The other end of the connecting pipe 12 is connected to a working gas chamber of the expander 13. In this manner, the working gas chamber of the compressor 11 is connected to the working gas chamber of the expander 13 by the connecting pipe 12.

As will be described later by reference to FIG. 2, the expander 13 includes an expander body 20, a displacer 22, and a support 40.

Figure 2:
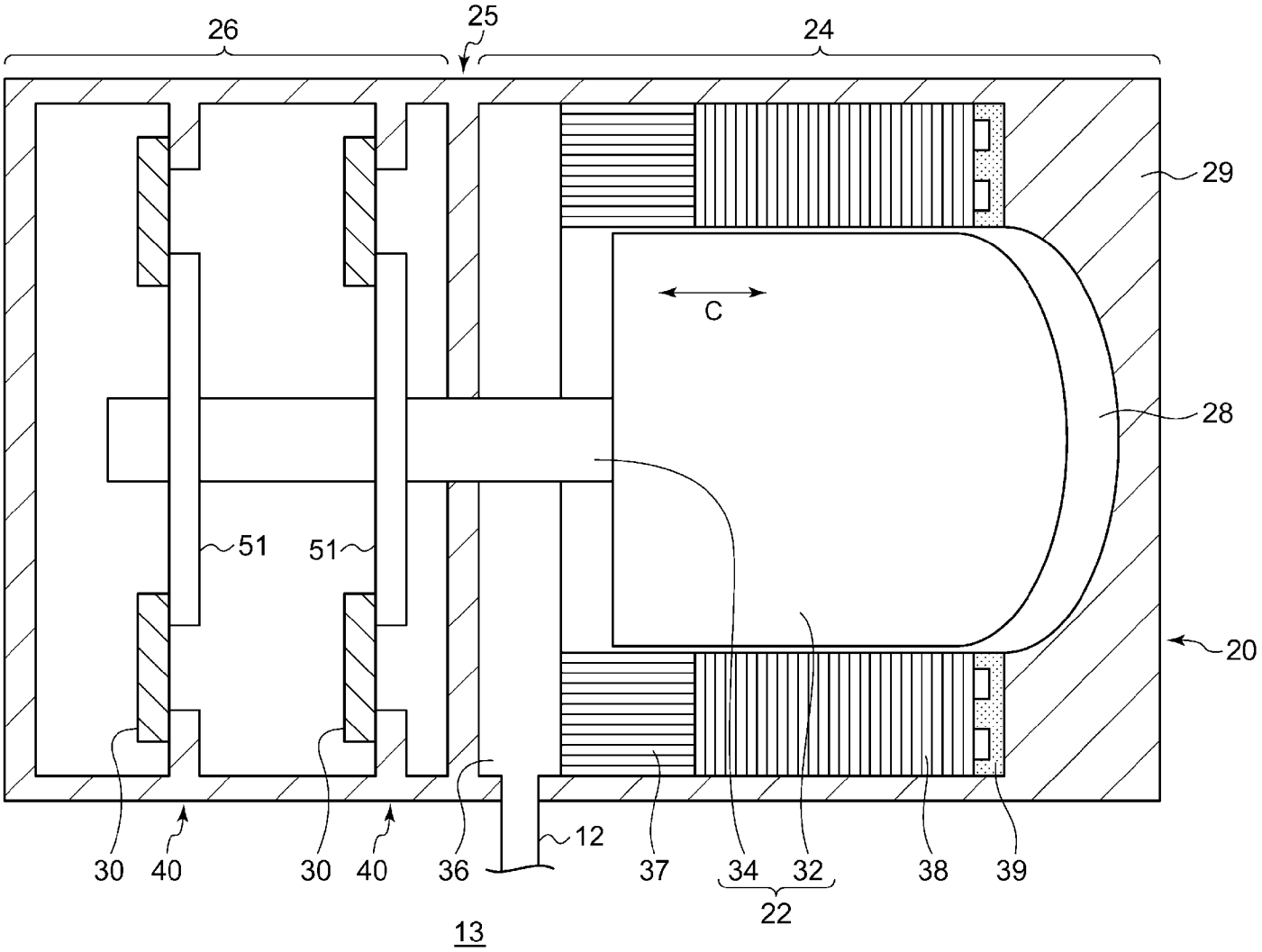
FIG. 2 schematically shows an expander of a Stirling refrigerator according to an embodiment of the present invention.

FIG. 2 schematically shows the expander 13 according to an embodiment of the present invention. FIG. 2 schematically illustrates an internal structure of the expander 13.

The expander 13 includes the expander body 20 and the displacer 22. The expander body 20 is a pressure vessel that is so configured as to hermetically hold a high-pressure working gas. The displacer 22 is a movable member that is so configured as to reciprocate inside the expander body 20. Also, the expander 13 includes at least one support 40 that supports the displacer 22 relative to the expander body 20 so that the displacer 22 can move in a reciprocating manner.

The expander body 20 includes a first section 24 and a second section 26. The first section 24 includes an expansion space 28, for the working gas, which is formed between the expander body 20 and the displacer 22. A cooling stage 29, which is used to cool an object, is provided in the part of the expansion body 20 adjacent to the expansion space 28. The second section 26 is configured such that the displacer 22 is supported relative to the expansion body 20 by way of an elastic member 30.

The second section 26 is located adjacent to the first section 24 in a reciprocating direction of the displacer 22 (indicated by a double arrow C in FIG. 2). A sealing portion 25 is provided between the second section 26 and the first section 24, and thereby the second section 26 is partitioned from the first section 24. Thus, the pressure variation of the working gas in the first section 24 is not at all transmitted to the second section 26 or has little effect on the pressure of the working gas in the second section 26. Note that the second section 26 is filled with a gas, which is the same kind as the working gas, such that the pressure thereof is equal to an average pressure of the working gas supplied from the compressor 11.

The displacer 22 includes a displacer body 32, which is contained in the first section 24, and a displacer rod 34. The displacer rod 34 is a shaft part, which is narrower than the displacer body 32. The displacer 22 has a central axis parallel with the reciprocating direction of the displacer 22, and the displacer body 32 and the displacer rod 34 are provided coaxially with the central axis. The displacer 22 has an internal space and is filled with a gas, which is the same kind as the working gas.

The displacer rod 34 extends from the displacer body 32 to the second section 26 by passing through the sealing portion 25. The displacer rod 34 is supported by the expander body 20 in the second section 26 in such a manner as to enable the reciprocating movement of displacer 22. The aforementioned sealing portion 25 may be a rod seal formed between the displacer rod 34 and the expander body 20.

The first section 24 forms a cylinder portion that surrounds the displacer body 32. The expansion space 28 is formed between a bottom face of the cylinder portion and an end face of the displacer body 32. The expansion space 28 is formed on a side opposite to a joint part of the displacer body 32 and the displacer rod 34, in the reciprocating direction C of the displacer 22. A gas space 36, which is connected to the connecting pipe 12, is formed between the joint part and the sealing portion 25.

A regenerator 38 is mounted on a side surface of the cylinder portion of the expander body 20 such that the regenerator 38 is positioned around a periphery of the displacer body 32. More specifically, the regenerator 38 is provided on the side surface of the cylinder portion of the expander body 20 such that the regenerator 38 is arranged around the periphery of the displacer body 32 to form a cylindrically-shaped region, whose central axis coincides with the longitudinal axis of the displacer 22. The regenerator 38 is of a stacking structure of metal meshes, for instance. The working gas can flow between the expansion space 28 and the gas space 36, by way of the regenerator 38.

A water-cooled heat exchanger 37 is provided between the regenerator 38 and the gas space 36. The water-cooled heat exchanger 37 performs a heat exchange operation in which the working gas supplied from the compressor 11 is cooled and then the heat thereof is released outside the expander 13. A low-temperature heat exchanger 39 is placed between the regenerator 38 and the cooling stage 29. In the Stirling refrigerator according to the present embodiment, the cooling stage 29 and the low-temperature heat exchanger 39 are structured integrally with each other. For convenience of explanation, a description is hereunder given in a manner such that the cooling stage 29 and the low-temperature heat exchanger 39 are separate elements. The low-temperature heat exchanger 39 will be discussed later in detail.

The expander 13 supports the displacer 22 relative to the expander body 20, at a plurality of positions in the reciprocating direction of the displacer 22, in such a manner as to enable the reciprocating movement of displacer 22. For this purpose, the expander 13 includes two supports 40. The two supports 40 are provided in the second section 26. In this manner, the tilting of the displacer 22 against the central axis can be suppressed.

Each support 40 has the aforementioned elastic member 30. The elastic member 30 is arranged between the displacer rod 34 and the expander body 20 such that an elastic restoring force is exerted on the displacer 22 when the displacer 22 is displaced from its neutral position. Thereby, the displacer 22 makes a reciprocating movement with a natural frequency. This natural frequency is determined by a spring constant of the elastic member 30, a spring constant resulting from the pressure of the working gas, and the weight of the displacer 22. The displacer rod 34 is secured to the elastic member 30 by way of an elastic member mounting portion 51.

The elastic member 30 includes, for example, a spring mechanism having at least one plate spring. The plate spring, which is also called a flexure spring, is flexible in the reciprocating direction of the displacer 22 and is rigid in a direction perpendicular to the reciprocating direction. Such a plate spring is disclosed, for example, in Japanese Patent Application Publication No. 2008-215440, the entire content of which is incorporated herein by reference. Thus, the elastic member 30 permits the movement of the displacer 22 in a direction along the central axis of the displacer 22 but restricts the movement thereof in a direction perpendicular thereto.

As described above, a vibration system comprised of the displacer 22 and the elastic member 30 is constructed. The vibration system is configured such that the displacer 22 vibrates with the same frequency as that of the movable member 15 of the compressor 11 with having a certain phase difference between these vibrations. The displacer 22 is driven by a pulsing motion caused by the pressure of the working gas generated by the vibration of the movable member 15 of the compressor 11. The reciprocating motions of the displacer 22 and the movable member 15 of the compressor 11 form a reverse Stirling cycle in between the expansion space 28 and the working gas chamber of the compressor 11. In this manner, the cooling stage 29 located adjacent to the expansion space 28 is cooled, so that the Stirling refrigerator can cool the object.

A detailed description is now given of the low-temperature heat exchanger 39 according to an embodiment.

Figure 3:
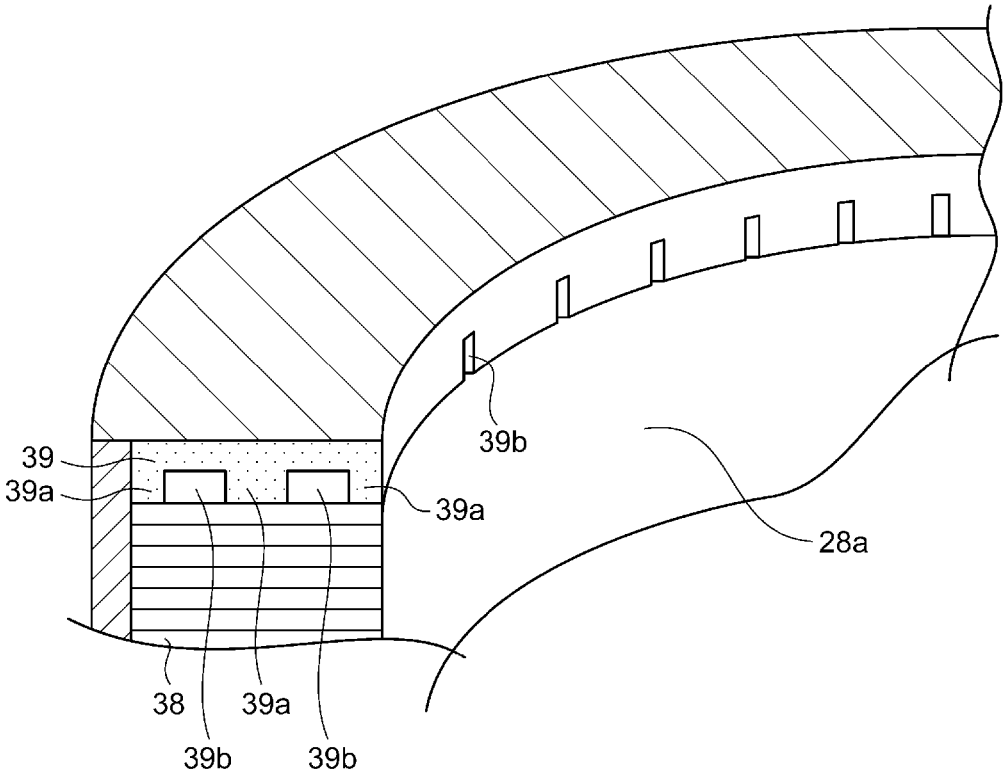
FIG. 3 is a perspective cross-sectional view to explain a heat exchanger according to an embodiment.

FIG. 3 is a perspective cross-sectional view to explain the low-temperature heat exchanger 39 according to an embodiment. The expander body 20 according to an embodiment is of a cylindrical shape. Thus, the low-temperature heat exchanger 39 according to an embodiment is of an annular shape. FIG. 3 is a perspective cross-sectional view obtained when a part of both the regenerator 38 and the low-temperature heat exchanger 39 is cut out along a plane parallel with and a plane perpendicular to the longitudinal axis of the displacer 22. An inner surface of the expansion space 28 is denoted by reference numeral 28*a* in FIG. 3.

The gas, which has passed from the compressor 11 through the connecting pipe 12 to the gas space 36, reaches the low-temperature heat exchanger 39 while the gas is cooled by the regenerator material of the regenerator 38. A plurality of protrusions 39*a*, which thermally contact with the regenerator 38, are formed on the low-temperature heat exchanger 39. Also, a plurality of recesses 39*b* are each formed between the adjacent protrusions 39*a* of the low-temperature heat exchanger 39, and each of the recesses 39*b* forms a flowing groove through which the working gas flows.

Since the low-temperature heat exchanger 39 has an annular shape, the protrusions 39*a* are annularly shaped as well. As a result, the recesses 39*b* are also annularly shaped. Note here that the low-temperature heat exchanger 39 according to an embodiment has a plurality of additional recesses 39*b* along a radial direction of the annular shape, i.e., a direction perpendicular to the annular recesses 39*b*. The working gas, which has reached the low-temperature heat exchanger 39 through the regenerator 38, now enters the flowing grooves formed by the recesses 39*b*. The working gas flowing along the flowing grooves passes through the additional recesses 39*b*, which extend in the radial direction of the low-temperature heat exchanger 39, and finally reaches the expansion space 28. Thus, the shape of the protrusion 39*a* formed on the low-temperature heat exchanger 39 can be thought of as being a discontinuing annular or circular shape having sub-protrusions arranged alternate with the radially extending grooves.

The reciprocating movement of the displacer 22 causes expansion of the working gas in the expansion space 28 and thereby produces the cold. The working gas, which has become colder, returns to the regenerator 38 through the recesses 39*b* of the low-temperature heat exchanger 39 and again reaches the gas space 36 while the cold working gas cools the regenerator material. This causes a temperature drop at an end of the regenerator 38 on a low-temperature heat exchanger 39 side relative to the temperature at the opposite end on a gas space 36 side. Accordingly, the end of the regenerator 38 on the low-temperature heat exchanger 39 side can be referred to as a low-temperature end of the regenerator 38. The end of the regenerator 38 on the gas space 36 side can be referred to as a high-temperature end of the regenerator 38.

As illustrated in FIG. 3, the protrusions 39*a* of the low-temperature heat exchanger 39 are in thermal contact with the low-temperature end of the regenerator 38 and also functions as a holder member by which the regenerator material of the regenerator 38 is physically firmly held in position. Since the regenerator material of the regenerator 38 has a mesh structure of metal wires as described earlier, the regenerator material may possibly be warped bulgingly in the direction from the high-temperature end toward the low-temperature end due to a pressure and/or temperature change of the working gas flow. The protrusions 39*a* of the low-temperature heat exchanger 39 can suppress such a deformation occurring in the regenerator material. This can mitigate or prevent such non-uniformity from occurring in the regenerator material of the regenerator 38, so that the regenerator material can be filled up and arranged uniformly in an axial direction of the displacer 22. As a result, the efficiency of the regenerator 38 can be improved.

Figure 4:
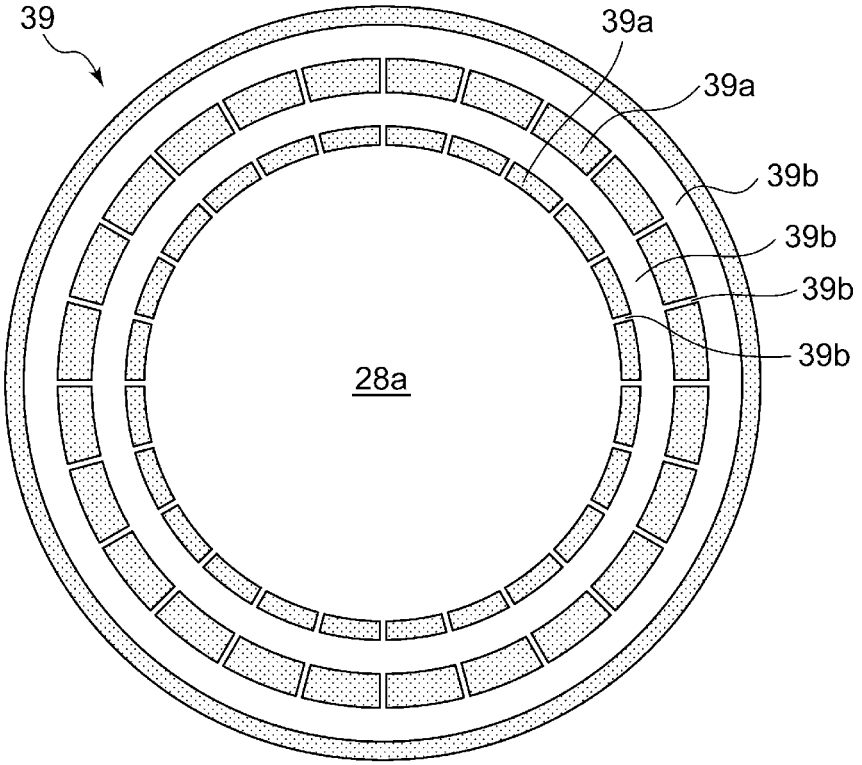
FIG. 4 schematically shows an external appearance of a heat exchanger according to an embodiment.

FIG. 4 schematically shows an external appearance of the low-temperature heat exchanger 39 according to an embodiment, and shows the low-temperature heat exchanger 39 as viewed from the regenerator 38 side. As shown in FIG. 4, the protrusions 39*a* are annularly arranged and placed coaxially with the outer circumferential part of the expander body 20, and the first recesses 39*b* are formed between the adjacent protrusions 39*a*. Further, the second recesses 39*b* extend in the radial direction of the low-temperature heat exchanger 39. The first and second recesses 39*b* in combination form the flowing grooves through which the working gas flows in and out the expansion space 28. In this manner, the working gas can be distributed over the whole area of the low-temperature heat exchanger 39, so that the heat-exchange efficiency between the working gas and the low-temperature heat exchanger 39 can be improved. Since the flowing grooves formed by the recesses 39*b* are uniformly formed on the low-temperature heat exchanger 39, the working gas makes uniform contact with the low-temperature heat exchanger 39 in its entirety without causing a biased distribution of the working gas. Thereby, the working gas, which passes through the low-temperature heat exchanger 39, uniformly reaches every part of the low-temperature end of the regenerator 38, so that a uniform temperature distribution over the low-temperature end of the regenerator 38 can be achieved.

Figure 5A:
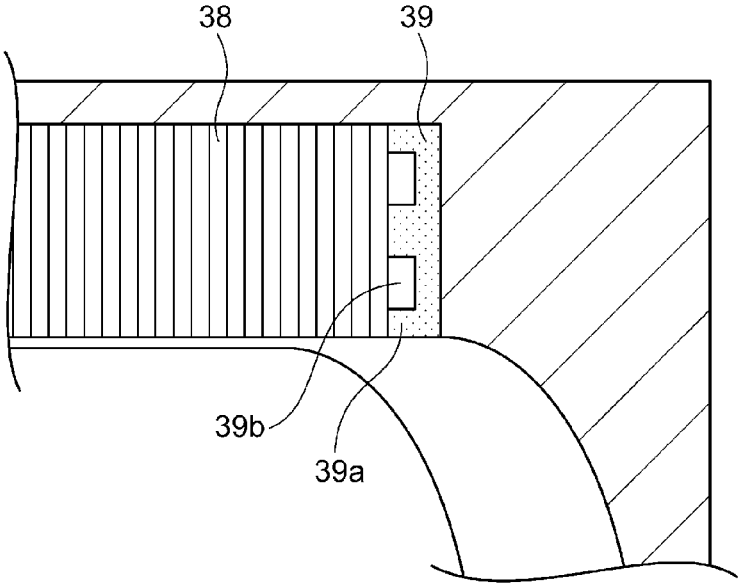
FIGS. 5A and 5B are diagrams for explaining a low-temperature heat exchanger according to an embodiment and one according to a comparative example, respectively.
Figure 5B:
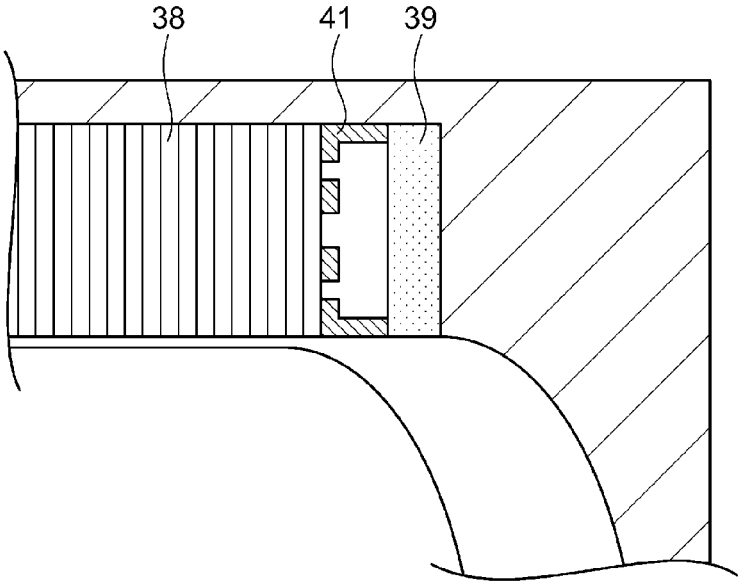

FIGS. 5A and 5B are diagrams for explaining a low-temperature heat exchanger 39 according to an embodiment and one according to a comparative example, respectively. More specifically, FIG. 5A is an enlarged partial view of an area including the regenerator 38 and the low-temperature heat exchanger 39 shown in FIG. 2. FIG. 5B is an enlarged partial view of an area, corresponding to the area shown in FIG. 5A, which includes the regenerator 38 and the low-temperature heat exchanger 39 according to the comparative example.

As shown in FIG. 5B, the low-temperature heat exchanger 39 according to the comparative example does not have the protrusions 39*a* and the recesses 39*b* as in the low-temperature heat exchanger 39 according to the present embodiment. Instead, the low-temperature heat exchanger 39 according to the comparative example is configured such that a regenerator material stage 41 is inserted between the regenerator 38 and the low-temperature heat exchanger 39 in order to ensure a flow path through which the working gas flows in and out of the regenerator 38. As shown in FIG. 5B, the regenerator material stage 41 not only supports the regenerator material of the regenerator 38 but also forms a gap or spacing, in between the regenerator 38 and the low-temperature heat exchanger 39, through which the working gas diffuses. With this arrangement implemented in the low-temperature heat exchanger 39 according to the comparative example, the working gas is uniformly in contact with the low-temperature heat exchanger 39, thereby improving the heat-exchange efficiency.

However, the low-temperature heat exchanger 39 according to the comparative example is configured such that the distance between the cooled object and the low-temperature end of the regenerator 38 is longer than that of the low-temperature heat exchanger 39 according to the present embodiment. The thermal resistance in the low-temperature heat exchanger 39 according to the comparative example, is larger than that of the low-temperature heat exchanger 39 according to the present embodiment. This leads to a drop in the heat-exchange efficiency.

In contrast, the low-temperature heat exchanger 39 according to the present embodiment is not only configured such that the low-temperature heat exchanger 39 itself has the flowing paths for the working gas but also has a function of supporting the regenerator material of the regenerator 38. Thus, the distance between the cooled object and the regenerator 38 is reduced and are located closer to each other, compared with the low-temperature heat exchanger 39 according to the comparative example. Accordingly, the thermal resistance between the regenerator 38 and the cooled object is reduced so that the refrigeration capacity can be enhanced. Also, the low-temperature heat exchanger 39 according to the present embodiment does not have the gap as in the low-temperature heat exchanger 39 according to the comparative example. Thus, the dead volume becomes small, which contributes to improving the refrigerating capacity.

Figure 6:
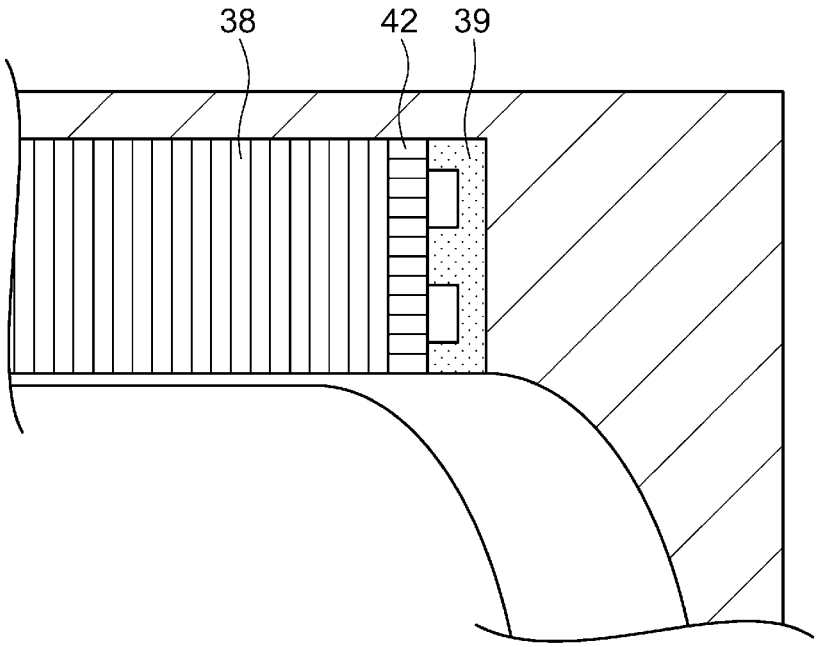
FIG. 6 is a diagram for explaining a regenerator and a low-temperature heat exchanger when a Stirling refrigerator includes a support member.

As described above, a description has been made so far on the assumption that the low-temperature heat exchanger 39 is in direct contact with the low-temperature end of the regenerator 38. Instead, a support member for supporting the regenerator material may be provided between the low-temperature heat exchanger 39 and the regenerator 38. FIG. 6 is a diagram for explaining a regenerator 38 and a low-temperature heat exchanger 39 when a Stirling refrigerator includes a support member 42.

As shown in FIG. 6, the support member 42 is inserted in between the regenerator 38 and the low-temperature heat exchanger 39. The support member 42 is in contact with the protrusions 39*a* of the low-temperature heat exchanger 39, and a pressing force from the protrusions 39*a* is evenly distributed across the regenerator material at the low-temperature end of the regenerator 38. This structure can mitigate or prevent the non-uniformity occurring in the regenerator material of the regenerator 38 in more efficient manner.

It is noted here that the support member 42 is preferably a plate or thin member for the purpose that the distance between the low-temperature heat exchanger 39 and the regenerator 38 is smaller so as to bring them closer to each other. Also, in order to suppress or minimize the pressure loss, the passage resistance of the working gas is preferably small. For this reason, the support member 42 may be implemented with a metal mesh having mesh openings of about 1 to 2 mm (#16), for example.

As described above, the Stirling refrigerator 10 according to an embodiment of the present invention provides the technology for mitigating a decrease of the refrigeration capacity of the Stirling refrigerator 10 having a regenerator. Since, in particular, the regenerator material of the regenerator 38 is firmly held by using the protrusions 39*a*, which constitute a part of the low-temperature heat exchanger 39, the distance between the low-temperature heat exchanger 39 and the regenerator 38 is small so as to bring them closer to each other and therefore the thermal resistance can be reduced. Thereby, the decrease of the refrigeration capacity of the Stirling refrigerator 10 can be mitigated. Also, the warping of the regenerator material of the regenerator 38 can be prevented.

The present invention has been described based on the exemplary embodiments and such description is for illustrative purposes only. It is understood by those skilled in the art that various changes in design and the like are possible and that such modifications arising from the changes are also within the scope of the present invention.

In the above-described embodiments, a description has been given on the assumption that the Stirling refrigerator 10 is an annular type Stirling refrigerator where the regenerator 38 is positioned in a cylindrically-shaped region whose central axis coincides with the longitudinal axis of the displacer 22. Nevertheless, the embodiments of the present invention is also applicable to a pulse tube Stirling refrigerator having no displacer 22.

As described above, the regenerator 38 of the annular type Stirling refrigerant 10 is of a cylindrical shape having a thick wall, and the cross section in a plane perpendicular to the longitudinal axis is of an annular shape. In contrast thereto, a regenerator of the pulse type Stirling refrigerator is of a columnar shape, and the cross section in the plane perpendicular to the longitudinal axis is a disk (circular plate), which is a difference from the regenerator 38 of the annular type Stirling refrigerant 10. Otherwise, the regenerator 38 of the pulse tube Stirling refrigerant may be configured similarly to the regenerator of the annular type Stirling refrigerator 10.

Thus, when the embodiments of the present invention are applied to the pulse tube Stirling refrigerator, the low-temperature heat exchanger is disk-shaped. In this case, a plurality of protrusions are formed on the surface of the disk-shaped low-temperature heat exchanger in thermal contact with the disk-shaped low-temperature end of the regenerator to form recesses, as flowing paths for the working gas, between the adjacent protrusions. With this structure and arrangement in this case, the embodiments of the present invention are applicable to the pulse tube Stirling refrigerator. As a result, in the case of the pulse tube Stirling refrigerator, the protrusions formed on the low-temperature heat exchanger are annularly or circularly shaped as well.

In the above-described embodiments, a description has been given of the case where the refrigerator is the Stirling refrigerator but the embodiments of the present invention are also applicable to a GM refrigerator and a Solvay refrigerator.

In the above-described embodiments, a description has been given mainly of the low-temperature heat exchanger 39 that thermally contacts with the low-temperature end of the regenerator 38. The embodiments of the present invention, however, are also applicable to a high-temperature heat exchanger of a refrigerator that includes the high-temperature heat exchanger thermally contacting with the high-temperature end of the regenerator 38.

It should be understood that the invention is not limited to the above-described embodiment, but may be modified into various forms on the basis of the spirit of the invention. Additionally, the modifications are included in the scope of the invention.

What is claimed is:

1. A Stirling refrigerator comprising:

an expander body;

a displacer configured to reciprocate inside the expander body to form an expansion space of a working gas between the expander body and the displacer;

a regenerator including a low-temperature end and a high-temperature end; and a heat exchanger, wherein the heat exchanger comprises, annularly arranged and coaxially placed protrusions in thermal contact with the low-temperature end of the regenerator, first annular and coaxial recesses formed between the annularly arranged and coaxially placed protrusions, and second radial recesses extending radially and connecting adjacent ones of the first annular and coaxial recesses, the second radial recesses dividing the annularly arranged and coaxially placed protrusions into circumferentially discontinuous sub-protrusions, the first annular and coaxial recesses and the second radial recesses in combination form a flowing groove through which the working gas flows between the low-temperature end of the regenerator and the expansion space.

2. The Stirling refrigerator according to claim 1, wherein the second radial recesses are configured as outlets for the heat exchanger through which the working gas flows into and out of the expansion space.

3. The Stirling refrigerator according to claim 1, wherein the regenerator contains a mesh regenerator material, wherein the Stirling refrigerator further comprises a support member disposed between the regenerator and the heat exchanger to support the regenerator material, and wherein the annularly arranged and coaxially placed protrusions are in contact with the support member.

* * * * *